US005525373A

United States Patent [19]

Chandler

[11] Patent Number: 5,525,373

[45] Date of Patent: Jun. 11, 1996

[54] SLIDE-BEAD COATING TECHNIQUE UTILING AN AIR FLOW PULSE

[75] Inventor: John T. Chandler, Brevard, N.C.

[73] Assignee: E. I. Du Pont de Nemours and Company, Wilmington, Del.

[21] Appl. No.: 323,673

[22] Filed: Oct. 18, 1994

Related U.S. Application Data

[60] Continuation of Ser. No. 247,731, May 23, 1994, abandoned, which is a division of Ser. No. 999,238, Dec. 31, 1992, Pat. No. 5,326,402.

[51] Int. Cl.[6] ..... B05D 3/04

[52] U.S. Cl. ..... 427/348; 427/402; 427/420; 118/410; 118/411; 118/62

[58] Field of Search ..... 427/402, 420, 427/348; 118/410, 411, 62

[56] References Cited

U.S. PATENT DOCUMENTS

| | | | |
|---|---|---|---|
| 2,761,419 | 9/1956 | Mercier et al. | 118/412 |
| 2,761,791 | 9/1956 | Russell | 117/34 |
| 3,220,877 | 11/1965 | Johnson | 117/120 |
| 3,676,178 | 7/1972 | Browatzki et al. | 117/34 |
| 4,024,302 | 5/1977 | Takagi et al. | 427/290 |
| 4,172,001 | 10/1979 | Heetderks | 156/157 |
| 4,292,349 | 9/1981 | Ishiwata et al. | 427/335 |
| 4,490,418 | 12/1984 | Yoshida | 427/445 |
| 4,808,444 | 2/1989 | Yamazaki et al. | 427/420 |
| 4,877,639 | 10/1989 | Willemsens et al. | 427/13 |
| 5,326,402 | 7/1994 | Chandler | 118/411 |

FOREIGN PATENT DOCUMENTS

| | | |
|---|---|---|
| 0261613A1 | 3/1988 | European Pat. Off. . |
| 0300098A1 | 1/1989 | European Pat. Off. . |
| 60-28851 | 2/1985 | Japan . |
| 1206280 | 9/1970 | United Kingdom . |

*Primary Examiner*—Shrive Beck
*Assistant Examiner*—Katherine A. Bareford
*Attorney, Agent, or Firm*—Thomas H. Magee

[57] ABSTRACT

A slide-bead coating technique utilizes an inclined slide surface terminating at a coating lip. A continuous liquid layer is supplied to the slide surface from a supply source so as to form a liquid bridge between the coating lip and a substrate disposed adjacent the coating lip. The substrate is conveyed past the lip and continuously depletes liquid from the liquid bridge onto the substrate. The technique includes supplying an air flow that impinges upon an upper surface of the liquid layer opposite the slide surface between the liquid supply source and the coating lip.

5 Claims, 4 Drawing Sheets

SLIDE-BEAD COATING TECHNIQUE UTILING AN AIR FLOW PULSE

This is a continuation of application Ser. No. 08/247,731, filed May 23, 1994 now abandoned which is a division of application Ser. No. 07/999,238 , filed Dec. 31, 1992 , now U.S. Pat. No. 5,326,402.

The present invention pertains to a slide-bead coating method and apparatus for coating a moving substrate. More specifically, this invention pertains to an air-assist apparatus for decreasing material loss due to coating initiation or aberrations during coating.

BACKGROUND OF THE INVENTION

Slide-bead coating is known in the art for supplying a flowing liquid layer or plurality of liquid layers down a slide surface to an efflux end, or lip, at which a liquid bridge, or bead, is formed in the gap between the lip and a moving substrate. The moving substrate carries away liquid from the liquid inventory in the bead in the same layered structure as that established on the slide. Exemplary examples are described in U.S. Pat. Nos. 2,761,791 and 2,761,419 issued to Russell et al.

Initiation of the slide-bead coating process is customarily accomplished in the following sequence, shown in FIGS. 1 and 2. In FIG. 1, the flow of coating solutions 1 and 2 is initially established with a coating roll 7 and coating plate 3 far enough apart so as to allow the coating solutions 1 and 2 to flow as a moving film of liquid over the face of the coating plate 3 and into a chamber 14 from which it is drained through a tube 16 into a sump 17. The coating plate 3 with associated assembly and coating roll 7 are then brought into close proximity to establish a flow across a coating gap 5 between the coating plate 3 and a substrate 6 supported by the coating roll 7, as shown in FIG. 2. Typically, the start-up coating is thicker than the steady-state coating that follows due to a brief shearing flow transient occurring upon initial dynamic wetting of the substrate. Several problems occur as a result of the initial thick flow, such as streaks, material loss and the like. Dynamic wetting is typically not identical across the substrate, thereby causing an uneven start of the coating process. This generates material loss due to uncoated sections of the substrate, as shown in FIG. 3, wherein A represents unsuitable material which occurs prior to establishment of a steady state, and B represents the desired steady-state coating. In severe cases, dynamic wetting does not occur at all and steady-state coating is not established. This typically occurs with viscosities that are inappropriate, coating rates that are inappropriate, and the like, as known in the art. Furthermore, bubbles, gel particles and other materials tend to generate streaks which often continue well into the steady-state coating.

U.S. Pat. No. 3,220,877 discloses a method using higher-than-normal differential pressure for inducing high air-flow rates down across the coater face as the coating roll is moved near the coating plate. The beneficial result is a reduction in the excess coating thickness at coating starts. Other technologies claiming this result include U.S. Pat. No. 4,808,444 issued to Yamazaki et.al, a method and apparatus for rapidly moving the coating roll between positions of coating and non-coating, and U.S. Pat. No. 4,877,639 issued to Willemsens et.al., a method consisting of at least two distinct liquid layers with different viscosities and with different flow rates. These inventions may have a beneficial effect in reducing the excess coating thickness at coating start. However, the coating start can also detrimentally affect the uniformity of the coating even after the normal coating thickness is established.

Continuous coating typically requires a transition from the lag end of a first substrate to the lead end of a second substrate in sequence. To decrease the amount of time required to change substrates, it is desirable to physically connect the lag end of the first substrate to the lead end of the second substrate to form a continuous moving substrate. The physical connection is generally done, as known in the art, by a splicing tape preferably overlapping both the lag and lead ends of the corresponding substrates with a spliced seam. As the spliced seam transits through the liquid bridge, the steady state flow characteristics are disturbed, causing defects in the coating. Flow disturbances can themselves reach a steady state which causes defects, such as streaks, well into the steady-state portion of the coating. Methods to eliminate disturbances from a spliced seam include rapidly reversing the aforementioned initiation process just prior to the splice, and reinitiating the process just after the splice. Such a method is inferior for the same reasons mentioned above for coating initiation.

Methods for improving the coatability of splices have been advanced by U.S. Pat. No. 4,172,001, issued to Heetderks, which teaches a two-piece splice tape. Disturbances still occur with the two-piece splice tape, albeit at a lower frequency, and the operation of splicing is complicated by an additional step. U.S. Pat. No. 4,024,302, issued to Takagi, et.al., teaches projecting discontinuous areas on the second substrate, which requires an additional step for preparation of the substrate surface and further complicates the manufacturing operation.

Yet another problem in coating continuous substrates is the presence of a foreign particle or aberration on the surface of the substrate. As these aberrations pass through the coating gap, disturbances occur in a manner analogous to a splice. These disturbances are typically sporadic and unexpected, which severely complicates efforts to prevent their occurrence. The present invention provides a single method for decreasing the material loss due to coating initiation, substrate splices and substrate surface aberrations.

SUMMARY OF THE INVENTION

The present invention comprises a slide-bead coating technique which utilizes an inclined slide surface terminating at a coating lip. A continuous liquid layer is supplied to the slide surface from a supply source so as to form a liquid bridge between the coating lip and a substrate disposed adjacent the coating lip. The substrate is conveyed past the lip and continuously depletes liquid from the liquid bridge onto the substrate. The present invention includes supplying an air flow that impinges upon an upper surface of the liquid layer opposite the slide surface between the liquid supply source and the coating lip.

DETAILED DESCRIPTION OF THE PREFERRED EMBODIMENTS

Figure 1:
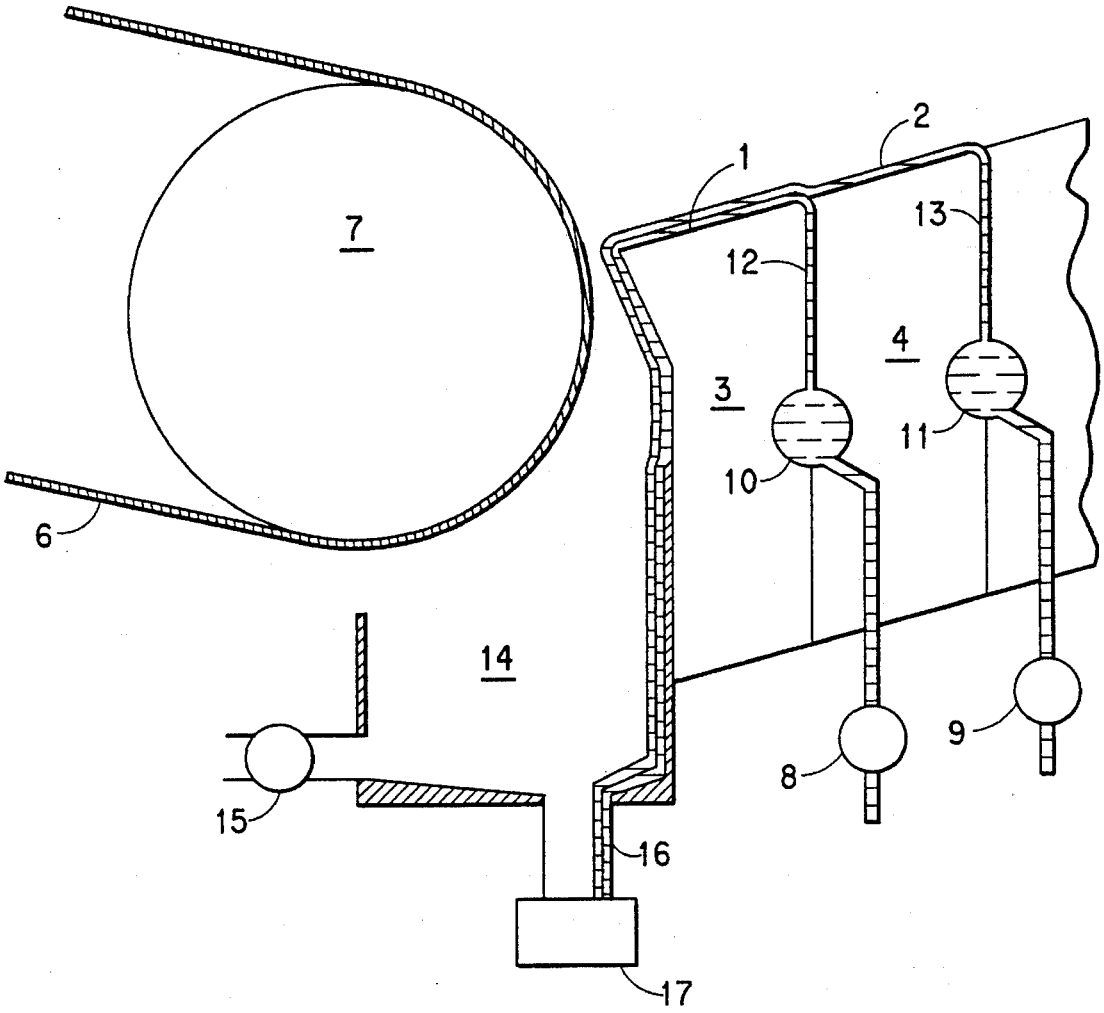
FIG. 1 (PRIOR ART)
FIG. 1 is a schematic partial elevation view showing a prior art slide-bead coating apparatus immediately prior to start of coating wherein the substrate and roller are separated from the coating plate and solution flow is removed by the chamber and associated sump.

FIG. 1 shows a side view of a conventional slide-bead coating apparatus prepared for the start of the coating operation. The same apparatus is displayed during the coating operation in FIG. 2. This apparatus will be described in detail with reference to FIG. 2. Solutions 1 and 2 to be coated are supplied to a slide-type hopper coating head assembly comprising coating plates 3 and 4. Coating additional layers would require additional plates which are not illustrated. The solutions 1 and 2 flow down the inclined slide surface and traverse a gap 5 between the lip of the coating plate 3 and a substrate 6, thereby forming a coated layer on the substrate 6. The substrate 6 to be coated is conveyed by a roller 7. The coating solutions 1 and 2 are supplied by an appropriate number of supply pumps 8 and 9, which feed into cavities 10 and 11, and slots 12 and 13. An appropriate number of pumps, cavities and slots are required to coat more layers than that depicted in the embodiment shown. A chamber 14 and an associated pump 15 are adapted to reduce the gas pressure on the lower surface of the liquid in the gap 5 (as viewed in FIG. 2). A drain tube 16 and sump 17 are typically provided to remove material from the chamber 14.

Figure 4:
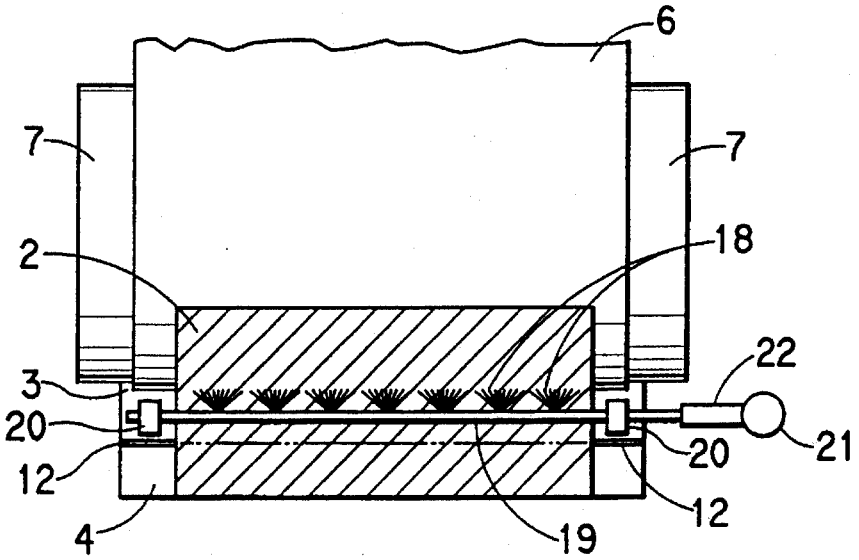
FIG. 4 is a plan view of one embodiment of the present invention during an operative air pulse.

FIG. 4 shows an embodiment of the present invention which comprises an air-assist apparatus 19 having a plurality of independent air-jets 18. The independent air-jets 18 form a curtain of air which impinges upon the upper surface of the coating solution 2. For coating initiation, the air impingement commences just after operative contact between the substrate 6 and the flowing solution 1. For coating a splice tape, as previously mentioned, the air impingement initiates just after the trailing edge of the splice tape enters the coating gap 5. The length of time required for air impingement, or pulse time, is related to many factors including coating velocity, solution viscosity, substrate wetability and the like. A pulse of less than 10 seconds duration is preferable, less than 5 seconds is more preferable and less than 2 seconds is most preferable. The air-assist apparatus 19 is rigidly mounted via brackets 20 to a suitable surface. The preferred mounting surface is the coating plate 3, although alternative mounting surfaces on the coating apparatus, or other structure, is included within the teaching herein. The air-jets 18 are connected to an air supply 21 by a tube 22. The air supply 21 can be any controlled air flow system well known in the art. The pulse of air can be mechanically controlled as known in the art, including manual operation. The air-assist apparatus 19 preferably comprises a tube with a multiplicity of exit holes for directing the air flow toward the flowing solution 2. The size of the tube and the holes are not critical provided air flow is substantially uniform across the width of the coating. For a nominal 14 cm. wide coating on a 15 cm. wide substrate, a tube with an outside diameter of approximately 0.9 cm containing round holes, approximately 0.3 cm in diameter, is exemplary for demonstration of the teaching herein. For wider coating widths, the hole size may be varied along the length of the tube to account for pressure loss, or multiple air-assist apparatuses may be used wherein each has an independent air supply. Independent operation of each exit hole is preferable for elimination of streaks, and coordinated operation is preferable at coating initiation or for coating a splice tape.

Figure 5:
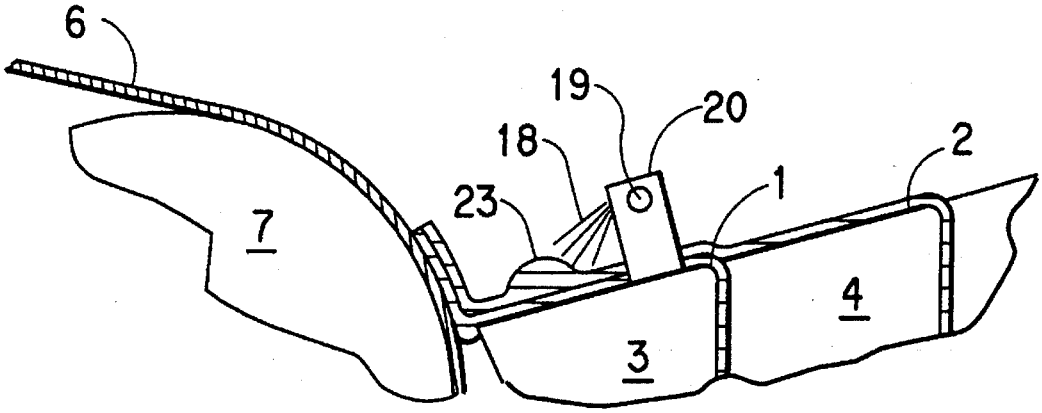
FIG. 5 is a partial cross-sectional elevation view of one embodiment of the present invention during an operative air pulse.

FIG. 5 illustrates a preferred embodiment of the present invention wherein the air jets 18 are directed towards the gap 5. Directing air flow towards the gap 5 creates a liquid wave of coating solution 23 which is moving in the same direction as the flowing liquid. While not restricted to any theory, one predominant problem with the initiation of coating is the removal of the entrained air layer from the surface of the moving substrate 6. In prior art coating, an initial wetting point is created which displaces the air across the substrate until the entire width reaches equilibrium. Once equilibrium is established, the differential pressure from the chamber continually eliminates the air layer. A pulse of air, as described herein, provides a thicker region of coating solution with an increased momentum in the direction of coating. The combination of the increased momentum and thicker coating solution increases the ability of the coating solution to displace the air layer, which decreases the amount of material loss typically observed when a coating is initiated. In effect, the momentary sheet of flowing air impinging on the coating solution near the lower end of the slide surface produces and drives the liquid wave down the slide against the substrate, thereby quickly initiating a continuous, full-width coating or eliminating coating blocks occurring at splices.

Figure 6:
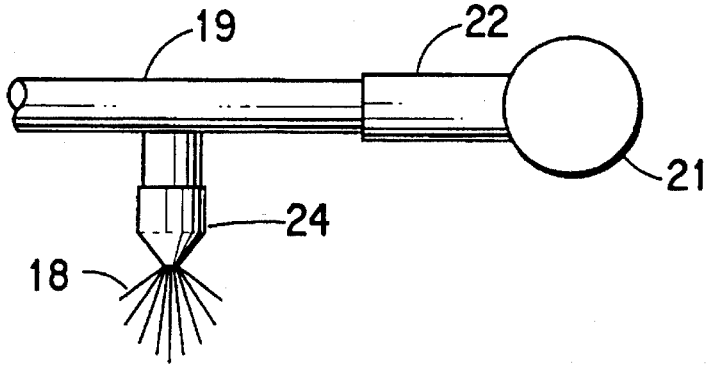
FIG. 6 is a plan view of an embodiment of the present invention wherein a nozzle is used to control air flow.

FIG. 6 shows a second embodiment wherein a nozzle 24 is attached to the air-assist apparatus, 19. Adjustable nozzles, as known in the art, are preferred but not required. A single supply 21 and tube 22 may be connected to each nozzle, or the same supply 21 may serve a multiplicity of nozzles.

The invention described herein is useful for a myriad of flowing liquid layers including, but not limited to, those with photosensitive and/or radiation sensitive liquids. These photosensitive and/or radiation sensitive layers may be used for imaging and reproduction in fields such as graphic arts, printing, medical, and information systems. Silver halide photosensitive layers and their associated layers are preferred. Photopolymer, diazo, vesicular image-forming compositions and other systems may be used in addition to silver halide. The substrate used in the novel process may be any suitable transparent plastic or paper known in the art. It is preferable to dry the substrate after coating by liquid medium evaporation, as known in the art.

Figure 2:
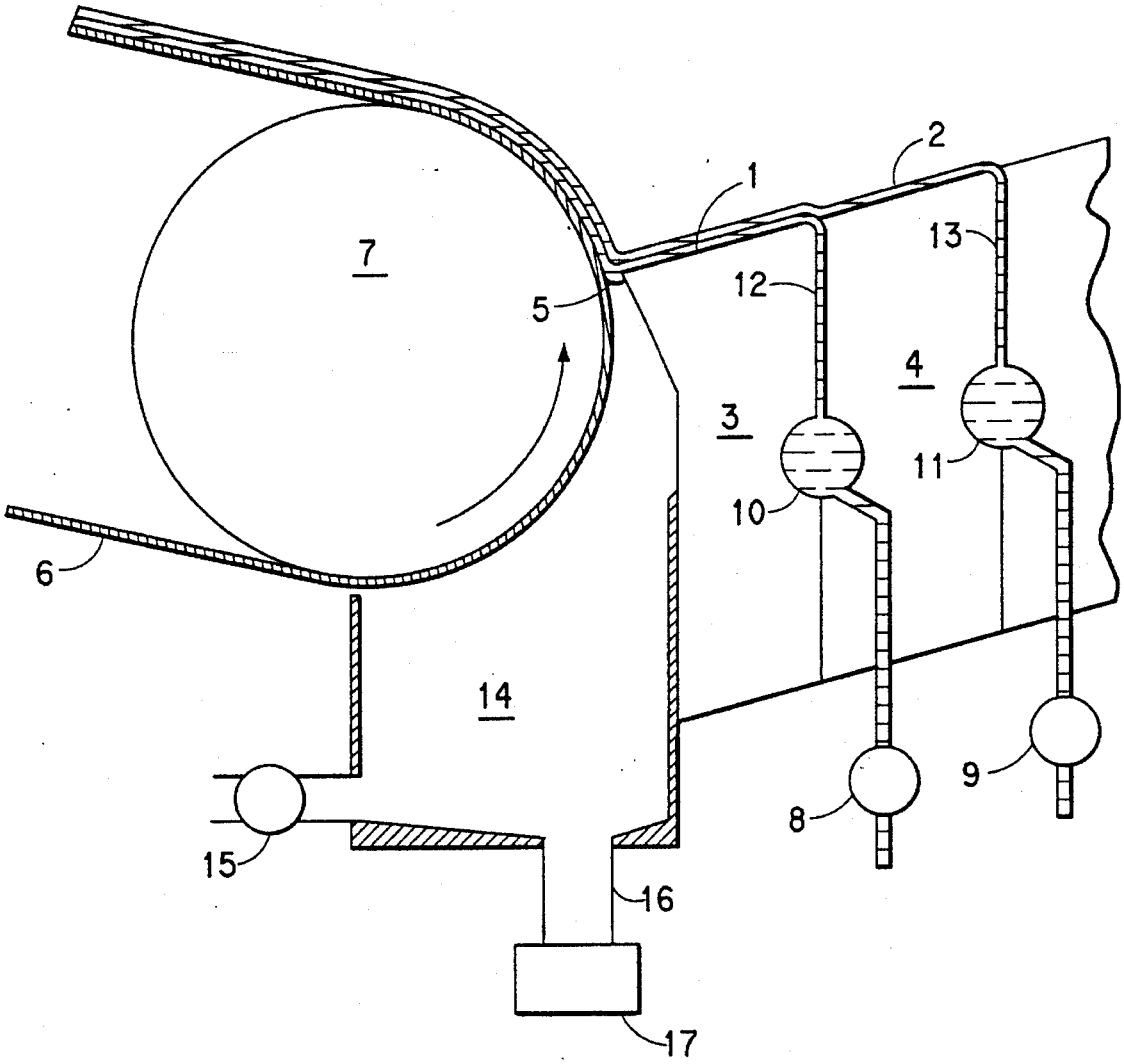
FIG.2 (PRIOR ART)
FIG. 2 is a schematic partial elevation view of the coating apparatus shown in FIG. 1 during steady-state coating wherein the flowing liquid forms a bridge between the coating plate and the moving substrate.
Figure 3:
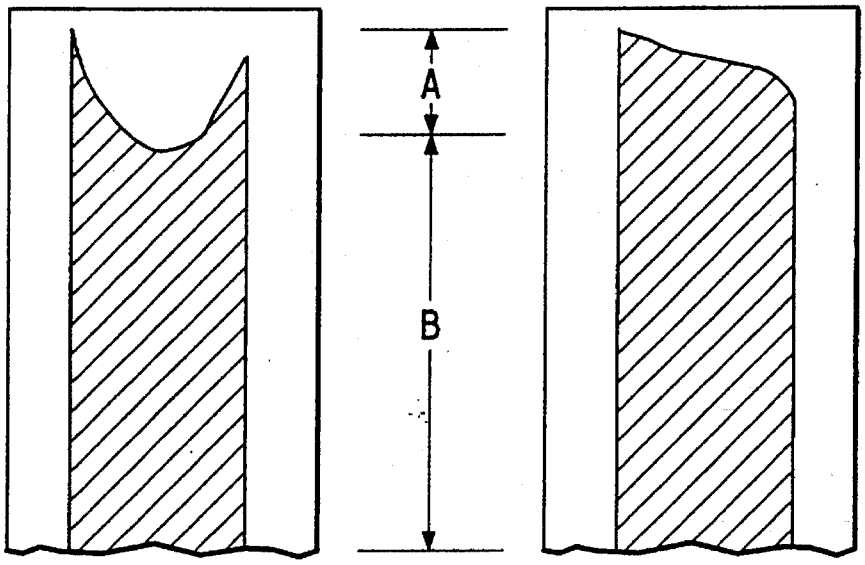
FIG.3 (PRIOR ART)
FIG. 3 is a plan view of a coated substrate, wherein A is the material loss which occurs prior to the establishment of a steady-state coating, and B is the desired steady-state coating.

These teachings are best displayed by the following examples which are not intended to limit the scope of the invention described herein. A flow of a single layer of 8% hydrophilic colloid solution was established on a slide-bead coating apparatus configured as shown in FIG. 1. The 14 cm wide flow was maintained at a flow rate of approximately 580 milliliters per minute. The roller drive was activated, and the 15 cm wide substrate was transported at a rate of approximately 114 meters per minute. The substrate was then translated toward the flowing liquid, as illustrated in FIG. 2, to establish a 0.007 inch gap. Within 1 second after observing contact between the substrate and the solution, a pulse of air approximately ½ second in duration impinged the surface of the flowing liquid, whereby a steady-state coating was established. After steady-state coating was established, a pressure of 0.7 inches of water below atmospheric pressure was measured in the chamber below the bead. A pressure of 30 pounds per square inch was supplied to the air-assist apparatus as measured by conventional means at the connecting tube. The air-assist apparatus consisted of a single tube with an outside diameter of 0.9 cm containing five evenly spaced 0.3 cm holes, which were approximately 2.5 cm apart. A manual valve was used for demonstration of the example herein. The flow rate and coating rate conditions were chosen such that a catastrophic coating initiation was observed, wherein steady-state coating would not occur without the air-assist apparatus. With the air-assist apparatus, a steady-state coating was observed with approximately 1 meter of material generated which was unsuitable for intended use.

What is claimed is:

1. In a method for coating a substrate including the steps of initiating a flow of liquid from a liquid layer supply means to form a continuous liquid layer on an inclined slide surface of a slide-bead coating apparatus, said apparatus having a coating lip at a lower end of said slide surface, transporting said substrate past said coating lip so as to form a liquid bridge between said coating lip and said substrate and to continuously deplete liquid from said bridge onto said substrate, said liquid in said bridge being continuously replenished from said liquid layer supply means, and coating said liquid onto said substrate, the improvement in said method comprising the step of supplying an air flow pulse that impinges directly from a supply source upon an upper surface of said liquid layer opposite said slide surface between said liquid layer supply means and said coating lip, said pulse of air being sufficient to create a thicker wave region in said liquid layer.

2. The method of claim 1 wherein said supplying step is performed by supplying said air flow pulse from a plurality of air streams.

3. The method of claim 2 wherein said supplying step is performed by operationally coupling said plurality of air streams for simultaneous operation.

4. The method of claim 2 wherein said supplying step is performed by independently operating said plurality of air streams.

5. The method of claim 1 wherein said supplying step is performed by supplying said air flow pulse through a nozzle.

* * * * *